US009025977B2

(12) United States Patent
Sugiyama et al.

(10) Patent No.: US 9,025,977 B2
(45) Date of Patent: May 5, 2015

(54) IMAGE FORMING APPARATUS

(71) Applicants: Hiroyuki Sugiyama, Kanagawa (JP); Jun Yura, Kanagawa (JP); Masaki Sukesako, Ibaraki (JP); Hironobu Takeshita, Kanagawa (JP); Takuya Suganuma, Kanagawa (JP); Takeshi Uchitani, Kanagawa (JP); Hiroki Ishii, Kanagawa (JP)

(72) Inventors: Hiroyuki Sugiyama, Kanagawa (JP); Jun Yura, Kanagawa (JP); Masaki Sukesako, Ibaraki (JP); Hironobu Takeshita, Kanagawa (JP); Takuya Suganuma, Kanagawa (JP); Takeshi Uchitani, Kanagawa (JP); Hiroki Ishii, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/175,632

(22) Filed: Feb. 7, 2014

(65) Prior Publication Data

US 2014/0233972 A1 Aug. 21, 2014

(30) Foreign Application Priority Data

Feb. 15, 2013 (JP) ..... 2013-028141

(51) Int. Cl.
*G03G 15/00* (2006.01)
*G03G 21/20* (2006.01)

(52) U.S. Cl.
CPC ..... *G03G 21/20* (2013.01); *G03G 15/55* (2013.01)

(58) Field of Classification Search
CPC ..... G03G 15/50; G03G 21/20; G03G 15/55
USPC ..... 399/44
See application file for complete search history.

(56) References Cited

U.S. PATENT DOCUMENTS

| | | | | |
|---|---|---|---|---|
| 6,542,703 | B1 * | 4/2003 | Jung | 399/44 |
| 7,177,559 | B2 * | 2/2007 | Inoue et al. | 399/44 |
| 2004/0240899 | A1 * | 12/2004 | Ebe | 399/44 |
| 2005/0078972 | A1 * | 4/2005 | Soda et al. | 399/44 |
| 2005/0238373 | A1 * | 10/2005 | Takayanagi | 399/44 |
| 2006/0204258 | A1 * | 9/2006 | Yamane | 399/44 |
| 2007/0110455 | A1 | 5/2007 | Ariizumi et al. | |
| 2008/0003000 | A1 * | 1/2008 | Taki et al. | 399/44 |
| 2008/0205917 | A1 * | 8/2008 | Ito | 399/44 |
| 2011/0026958 | A1 * | 2/2011 | Shiori | 399/53 |
| 2011/0142460 | A1 * | 6/2011 | Sugano | 399/44 |
| 2012/0045235 | A1 * | 2/2012 | Shiori et al. | 399/53 |
| 2012/0134691 | A1 * | 5/2012 | Soda | 399/44 |
| 2012/0134692 | A1 * | 5/2012 | Soda | 399/44 |
| 2012/0230711 | A1 | 9/2012 | Shiori et al. | |
| 2014/0064753 | A1 * | 3/2014 | Saeki | 399/43 |

(Continued)

FOREIGN PATENT DOCUMENTS

| | | |
|---|---|---|
| JP | 2001-147621 | 5/2001 |
| JP | 2006-251504 | 9/2006 |
| JP | 2010-134407 | 6/2010 |

(Continued)

*Primary Examiner* — David Bolduc
(74) *Attorney, Agent, or Firm* — Duft Bornsen & Fettig LLP

(57) ABSTRACT

An image forming apparatus capable of continuous image formation on multiple pages includes an image bearer to bear an image, a latent image forming unit to form a latent image on the image bearer, a developing device to develop the latent image with toner, a temperature sensor to detect temperature inside the developing device or adjacent to the developing device, a controller to impose a limit on a quantity of pages in continuous image formation and cancel the limit according to a detection result generated by the temperature sensor, and a report unit to report time data indicating when the limit is imposed.

14 Claims, 9 Drawing Sheets

(56) References Cited

U.S. PATENT DOCUMENTS

2014/0064756 A1* 3/2014 Sugiyama et al. ..... 399/44
2014/0064766 A1* 3/2014 Saeki ..... 399/69

FOREIGN PATENT DOCUMENTS

JP 2012093427 A * 5/2012
JP 2012-198495 10/2012

* cited by examiner

IMAGE FORMING APPARATUS

CROSS-REFERENCE TO RELATED APPLICATION

This patent application is based on and claims priority pursuant to 35 U.S.C. §119 to Japanese Patent Application No. 2013-028141, filed on Feb. 15, 2013, in the Japan Patent Office, the entire disclosure of which is hereby incorporated by reference herein.

BACKGROUND OF THE INVENTION

1. Technical Field

This invention generally relates to an image forming apparatus, such as a copier, a printer, a facsimile machine, and a multifunction machine including at least two of coping, printing, facsimile transmission, plotting, and scanning capabilities.

2. Description of the Background Art

Conventionally, when a large number of sheets are continuously fed for a long time in electrophotographic image forming apparatuses, an image forming unit is continuously driven for a long time. Consequently, temperature inside the image forming apparatus and those of components thereof rise. Accordingly, various approaches have been tried for temperature control.

For example, there are image forming apparatuses that include a cooling fan or duct to prevent the temperature inside the image forming apparatus and those of the components from rising above a predetermined temperature, and there are high-speed image forming apparatuses that include an air conditioner to adjust temperature inside the apparatus.

Additionally, in image forming apparatuses in which temperature of a fixing roller locally rises due to continuous feeding of small sheets, the temperature of the fixing roller is directly monitored to temporarily increase the sheet feeding interval, thereby make the temperature of the fixing roller uniform.

Further, JP-2010-134407-A discloses an image forming apparatus aimed at suppressing excessive temperature rises of a developing motor without directly detecting the temperature of the developing motor. In this image forming apparatus, fluctuations in temperature of the developing motor is calculated based on the operation mode of the image forming apparatus, a power source off time during which a power source is turned off is estimated based on the change in temperature of a fixing thermistor, the fluctuations in temperature of the developing motor is corrected based on the power source off time, and an environment temperature is added to the corrected fluctuations in temperature of the developing motor to calculate the estimated temperature of the developing motor. When the temperature of the developing motor rises to 100° C. or higher, the image forming apparatus intermittently executes image formation in such a manner that the continuous image formation and standby in which image formation is not performed are repeated until the estimated temperature of the developing motor falls 80° C. or lower.

Further, JP-2006-251504-A discloses an image forming apparatus aimed at preventing firm adhesion of toner onto a toner regulating member when the amount of toner consumed is large. In the image forming apparatus, the number of toner images per dot formed on an image bearer is counted, and when the count value reaches a predetermined reference value or greater, a series of image formation is executed after stopping the rotation of a developing roller for a predetermined time, thereby cooling the toner layer on the developing roller.

SUMMARY OF THE INVENTION

In view of the foregoing, one embodiment of the present invention provides an image forming apparatus that is capable of continuous image formation on multiple pages and includes an image bearer to bear an image, a latent image forming unit to form a latent image on the image bearer, a developing device to develop the latent image with toner, a temperature sensor to detect temperature inside the developing device or adjacent to the developing device, a controller, and a report unit. The controller imposes a limit on a quantity of pages in continuous image formation and cancels the limit according to a detection result generated by the temperature sensor; and the report unit reports time data indicating when the limit is imposed.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
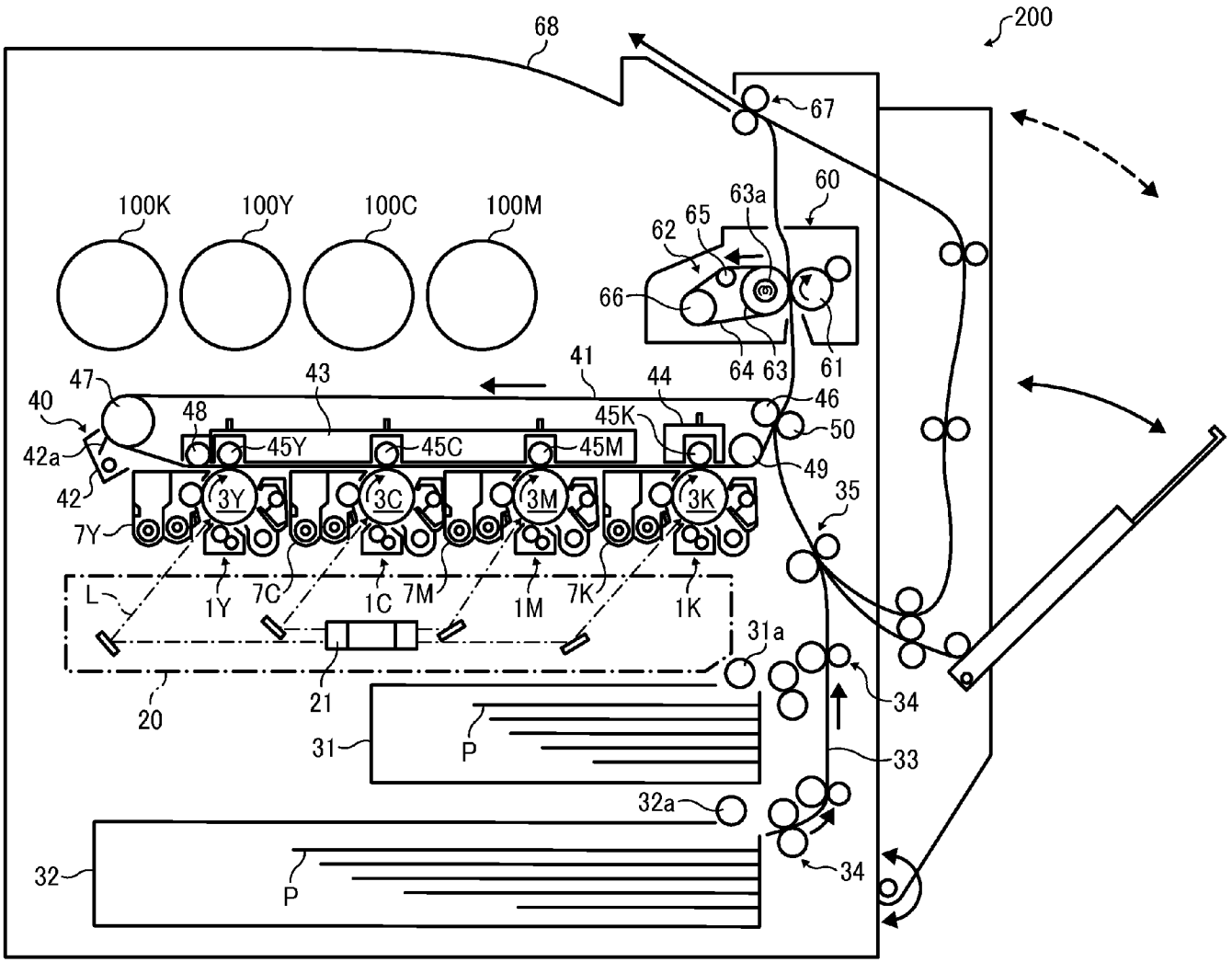
FIG. 1 is a schematic diagram illustrating a configuration of an entire image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In cases in which the interior of an image forming apparatus is cooled using a cooling fan or duct, there is a limitation in temperature lowered due to limitations in size and configuration of the image forming apparatus and layout of components therein.

Depending on the location where the temperature rise causes inconveniences, it is difficult to directly monitor temperature and thus temperature control thereof is difficult. In particular, when an image forming unit having a developing device is continuously driven for a long time, a sliding member, such as a bearing, and developer in the developing device are significantly heated, and accordingly developer (toner) can be fused in the developing device. It is difficult to directly monitor the temperatures of the sliding member and that of developer.

It is proposed in US20120230711(A1) published on Sep. 13, 2012, which is hereby incorporated by reference herein, that temperature inside the developing device or adjacent thereto that changes corresponding to the temperature of the developer bearer is detected, and the number of pages on which images are formed consecutively is limited based on the detection result. The limitation is canceled also based on the detection result.

The embodiment described below is intended to improve this approach and to provide an image forming apparatus capable of suppressing reduction in efficiency during continuous image formation, suppressing fusion of developer due to an excessive temperature rise of developer on a developer bearer, and allowing users to manage the image formation, without computing estimated temperatures of the developer bearer and developer in the developing device.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Figure 2:
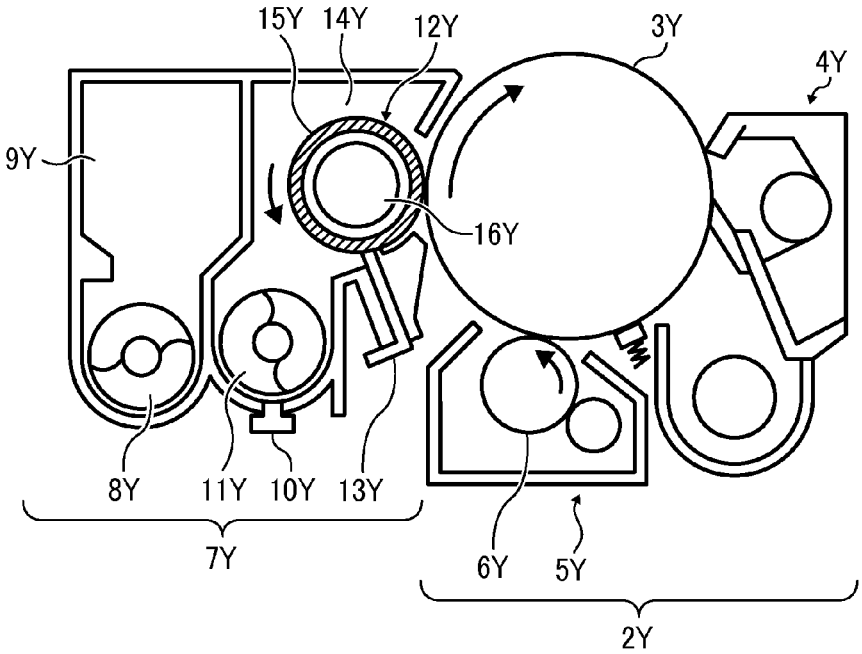
FIG. 2 is a schematic diagram showing a configuration of a yellow image forming unit used in the image forming apparatus shown in FIG. 1.
Figure 3:
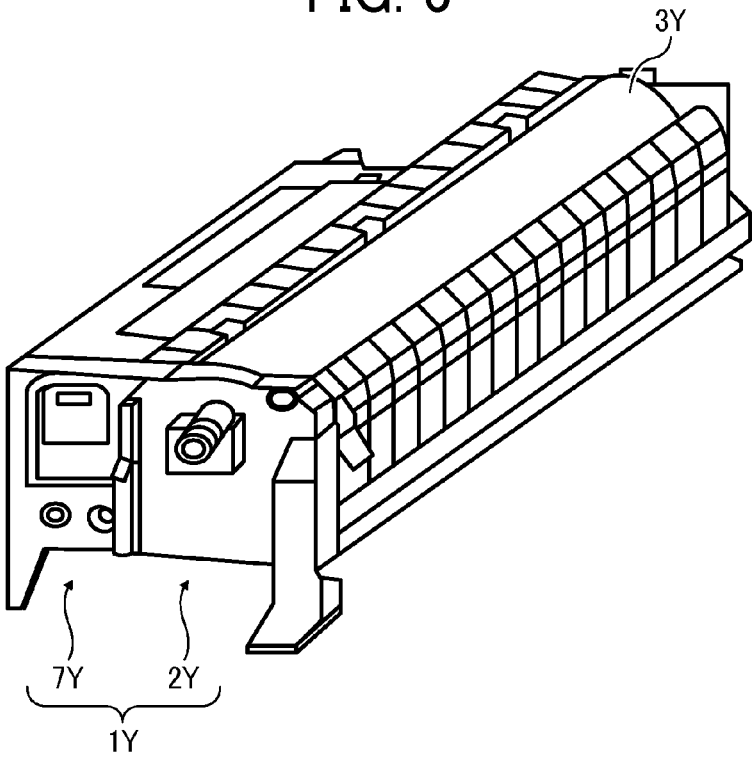
FIG. 3 is a perspective view of the yellow image forming unit shown in FIG. 2.

FIG. 1 is a schematic diagram illustrating a configuration of an entire image forming apparatus according to an embodiment of the present invention. FIG. 2 is a schematic diagram showing a configuration of a yellow image forming unit used in the image forming apparatus shown in FIG. 1. FIG. 3 is a perspective view of the yellow image forming unit. An image forming apparatus 200 shown in FIG. 1 includes four image forming units 1Y, 1C, 1M, and 1K for forming yellow, cyan, magenta, and black toner images. The image forming units 1Y, 1C, 1M, and 1K have a similar configuration except that the color of developer or toner (i.e., an image forming material) used therein to form images is different. The image forming units 1 are described below using the image forming unit 1Y for yellow as an example. As shown in FIG. 2, the image forming unit 1Y includes a photoreceptor unit 2Y including a drum-shaped photoreceptor 3Y, and a developing device 7Y to develop latent images formed on the photoreceptor 3Y. The photoreceptor unit 2Y and the developing device 7Y can be united into the image forming unit 1Y as shown in FIG. 2 and installed in and removed from an apparatus body of the image forming apparatus 200 together at a time. The developing device 7Y is formed as a modular unit (i.e., a developing unit) that can be separated from the photoreceptor unit 2Y when removed from the apparatus body.

An optical writing unit 20, serving as a latent image forming unit, is disposed beneath the image forming units 1 in the drawing. The optical writing unit 20 directs laser beams L onto the photoreceptors 3 in the respective image forming units 1 after the photoreceptors 3 are charged. Thus, electrostatic latent images for yellow, cyan, magenta, and black are formed on the respective photoreceptors 3 serving as latent image bearers. Specifically, the optical writing unit 20 directs the laser beams L emitted from a light source to the respective photoreceptors 3 via multiple optical lenses and mirrors while deflecting the laser beams L with a polygon mirror 21 rotated by a motor. Instead of the above-described configuration, a light scanning mechanism employing a light-emitting diode (LED) array may be used.

Beneath the optical writing unit 20 in FIG. 1, first and second sheet trays 31 and 32 for containing sheets P of recording media are arranged vertically. The sheet trays 31 and 32 contains piled multiple sheets P of recording media, and first and second feed rollers 31*a* and 32*a* are in contact with the sheets P on the top on the sheet trays 31 and 32, respectively.

When the first feed roller 31*a* is rotated counterclockwise in the drawing by a driving unit, the top sheet P in the sheet tray 31 is fed to a sheet feed channel 33 extending vertically on the right in the drawing. When the second feed roller 32*a* is rotated counterclockwise in the drawing by the driving unit, the top sheet P in the sheet tray 32 is fed to the sheet feed channel 33. Multiple pairs of conveyance rollers 34 are provided in the sheet feed channel 33, and the sheet P is sandwiched between the conveyance rollers 34 and transported upward in the drawing.

A pair of registration rollers 35 is provided at the downstream end of the sheet feed channel 33 in the direction in which the sheet P is conveyed (hereinafter "sheet conveyance direction"). The pair of registration rollers 35 stops rotating immediately after the sheet P is sandwiched therebetween and then forwards the sheet P to a secondary-transfer nip timed to coincide with image formation.

A transfer unit 40 including an intermediate transfer belt 41 stretched around multiple rollers is disposed above the image forming units 1. The transfer unit 40 rotates the intermediate transfer belt 41 counterclockwise in the drawing. The transfer unit 40 includes a belt cleaning unit 42 and first and second brackets 43 and 44 in addition to the intermediate transfer belt 41. The transfer unit 40 further includes four primary-transfer rollers 45, a secondary-transfer backup roller 46, a driving roller 47, an auxiliary roller 48, and a tension roller 49, around which the intermediate transfer belt 41 is stretched. The intermediate transfer belt 41 is rotated counterclockwise in FIG. 1 as the driving roller 47 rotates. The four primary-transfer rollers 45 press against the respective photoreceptors 3 via the intermediate transfer belt 41, thus forming primary-transfer nips. Each primary-transfer roller 45 applies a transfer bias whose polarity (for example, positive) is opposite that of toner to the back surface (inside the loop) of the intermediate transfer belt 41. As the intermediate transfer belt 41 rotates and passes through the four primary-transfer nips sequentially, yellow, cyan, magenta, and black toner images formed on the photoreceptors 3Y, 3C, 3M, and 3K are transferred and superimposed one on another on the intermediate transfer belt 41 (primary-transfer process), thus forming a four-color toner image on the intermediate transfer belt 41.

The secondary-transfer backup roller 46, which is a part of a secondary-transfer mechanism, and a secondary-transfer roller 50 press against each other via the intermediate transfer belt 41, thus forming a secondary-transfer nip therebetween. The registration rollers 35 forward the sheet P clamped therebetween to the secondary-transfer nip, time to coincide with the four-color image on the intermediate transfer belt 41. In the secondary-transfer nip, due to the effects of the secondary-transfer electrical field formed between the secondary-transfer roller 50 and the secondary-transfer backup roller 46 and nip pressure, the four-color toner image is transferred secondarily from the intermediate transfer belt 41 onto the sheet P at a time. Then, the four-color toner image becomes a full color toner image (hereinafter "multicolor toner image") on the while sheet P.

Then, the belt cleaning unit 42 removes toner remaining on the intermediate transfer belt 41 after the intermediate transfer belt 41 passes the secondary-transfer nip. It is to be noted that the belt cleaning unit 42 removes toner with a cleaning blade 42*a* that contacts the front surface (outer circumferential surface) of the intermediate transfer belt 41.

Above the secondary-transfer nip in the drawing, a fixing device 60 to fix the toner image on the sheet P is provided. The fixing device 60 includes a pressure roller 61 and a fixing belt unit 62. Inside the pressure roller 61, a heat source such as a halogen lamp is provided. The fixing belt unit 62 includes a fixing belt 64, a heating roller 63 including a heat source 63*a* such as a halogen lamp, a tension roller 65, and a driving roller 66. The fixing belt 64, which is an endless belt, is stretched around the heating roller 63, the tension roller 65, and the driving roller 66 and rotated counterclockwise in the drawing. While rotating, the fixing belt 64 is heated by the heating roller 63 from the back side (inner face). The pressure roller 61 rotates clockwise in the drawing and contacts, from the front side (outer face), a portion of the fixing belt 64 stretched around the heating roller 63. With this configuration, a fixing nip is formed between the pressure roller 61 and the fixing belt 64 pressing against each other.

Outside the loop of the fixing belt 64, a temperature sensor is disposed facing the outer face of the fixing belt 64 across a predetermined clearance to detect the surface temperature of the fixing belt 64 immediately before entering the fixing nip. The results of detection are transmitted to a fixing power supply circuit. The fixing power supply circuit turns on and off power supply to the heat source 63*a* inside the heating roller 63 and the heat source inside the pressure roller 61 according to the detection results generated by the temperature sensor. Thus, the surface temperature of the fixing belt 64 is kept at, for example, about 140°.

After passing through the secondary-transfer nip, the sheet P leaves the intermediate transfer belt 41 and enters the fixing device 60. While the sheet P is nipped in the fixing nip of the fixing device 60 and transported upward in FIG. 1, the fixing belt 64 and the pressure roller 61 heat and press the sheet P, thereby fixing the toner image thereon.

Subsequently, the sheet P is discharged by a pair of discharge rollers 67 outside the image forming apparatus 200. The sheets P discharged by the discharge rollers 67 are sequentially stacked on a stack portion 68 formed on an upper face of the apparatus body. Toner cartridges 100Y, 100C, 100M, and 100K containing yellow, cyan, magenta, and black toners, respectively, are provided above the transfer unit 40. The respective color toners in the toner cartridges 100Y, 100C, 100M, and 100K are supplied to the developing devices 7Y, 7C, 7M, and 7K in the image forming units 1Y, 1C, 1M, and 1K as required. The toner cartridges 100Y, 100C, 100M, and 100K can be installed in and removed from the apparatus body separately from the image forming units 1Y, 1C, 1M, and 1K.

In FIG. 2, the photoreceptor unit 2Y includes the photoreceptor 3Y, a drum cleaning device 4Y, a discharger, and a charging device 5Y to charge the surface of the photoreceptor 3Y. The charging device 5Y uniformly charges the surface of the photoreceptor 3Y that is rotated clockwise in FIG. 2 by a driving unit. In the charging device 5Y shown in FIG. 2, while a power source applies a charging bias to a charging roller 6Y that rotates counterclockwise in FIG. 2, the charging roller 6Y is disposed close to the photoreceptor 3Y, thereby charging the photoreceptor 3Y uniformly. Alternatively, instead of the charging roller 6Y, a charging brush may be disposed in contact with the photoreceptor 3Y. Yet alternatively, chargers such as a scorotron charger may be used. The optical writing unit 20 (shown in FIG. 1) directs the laser beam L onto the uniformly charged surface of the photoreceptor 3Y, thus forming an electrostatic latent image for yellow thereon.

The developing device 7Y includes two developer containing chambers, namely, first and second chambers 9Y and 14Y. The first chamber 9Y is provided with a first conveying screw 8Y. The second chamber 14Y is provided with a density sensor 10Y to detect the density of toner (or toner concentration sensor to detect the concentration of toner in developer, a second conveying screw 11Y, a developing roller 12Y serving as a developer bearer, and a doctor blade 13Y serving as a developer regulator. The density sensor 10Y may be a magnetic permeability sensor. Two-component developer including magnetic carrier and negatively charged toner is contained in the first and second chambers 9Y and 14Y. Driven by a driving unit, the first conveying screw 8Y transports developer inside the first chamber 9Y from the proximal side to the distal side in the direction perpendicular to the surface of the paper on which FIG. 2 is drawn. Then, the developer moves to the second chamber 14Y through a communicating opening formed in a partition between the first and second chambers 9Y and 14Y.

The second conveying screw 11Y inside the second chamber 14Y rotates and transports developer from the distal side to the proximal side in the direction perpendicular to the surface of the paper on which FIG. 2 is drawn. The density sensor 10Y is fixed to the bottom of the second chamber 14Y and detects the concentration of toner in the developer transported. The developing roller 12Y is disposed above the second conveying screw 11Y and parallel to the second conveying screw 11Y. The developing roller 12Y includes a developing sleeve 15Y that rotates counterclockwise in FIG. 2 and a magnet roller 16Y provided inside the developing sleeve 15Y. The developing sleeve 15Y can be a nonmagnetic pipe, for example. A part of developer transported by the second conveying screw 11Y is scooped onto the surface of developing sleeve 15Y due to magnetic force exerted by the magnet roller 16Y. The doctor blade 13Y disposed across a predetermined gap from the developing sleeve 15Y adjusts the layer thickness of developer carried on the developing sleeve 15Y, after which developer is transported to a development range facing the photoreceptor 3Y. Then, toner adheres to the electrostatic latent image formed on the photoreceptor 3Y, thereby developing it into a yellow toner image. After yellow toner therein is thus consumed, yellow developer is returned to the second conveying screw 11Y as the developing sleeve 15Y rotates. The developer is transported to the proximal end in FIG. 2 and returned though the communicating opening to the first chamber 9Y.

A voltage indicating the magnetic permeability detected by the density sensor 10Y is transmitted to a controller as a signal. Since the magnetic permeability of developer has a good correlation with the concentration of toner in developer, the density sensor 10Y outputs a voltage corresponding to the toner concentration. For example, the controller includes a central processing unit (CPU) and a memory device such as a random-access memory (RAM) and a read-only memory (ROM). The memory device stores target values Vtref for the respective colors that are targets of voltages output from the density sensor 10Y and other density sensors 10 provided to the respective developing devices 7. For supplying yellow toner, the voltage output from the density sensor 10Y is compared with the target value Vtref for yellow, and a yellow toner replenishing device is driven for a time period according to the comparison result. Then, yellow toner is supplied to the first chamber 9Y to compensate for the decrease in the concentration of yellow toner consumed in image development. Thus, the concentration of yellow toner in developer contained in the second chamber 14Y can be kept in a predetermined or desirable range. Similar toner supply control is performed in the image forming units 1C, 1M, and 1K.

The yellow toner image is primarily transferred from the photoreceptor 3Y onto the intermediate transfer belt 41. Then, the drum cleaning device 4Y removes toner remaining on the surface of the photoreceptor 3Y after the primary-transfer process. Further, the discharger electrically discharges the cleaned surface of the photoreceptor 3Y, and thus the photoreceptor 3Y is initialized in preparation for subsequent image formation.

In other image forming units 1 as well, toner images are formed on the respective photoreceptors 3 and primarily transferred onto the intermediate transfer belt 41.

In the image forming apparatus 200 of the above configuration, a temperature sensor 905 is provided in the developing device 7Y or adjacent to the developing device 7Y in the apparatus body, that is, at a position to attain a detected temperature having a good correlation with temperature inside the developing unit. The temperature sensor 905 detects the temperature inside the developing device 7Y or adjacent thereto that changes corresponding to the temperature of the developing sleeve 15Y. The image forming units 1 for other colors have an identical or similar configuration.

Figure 4:
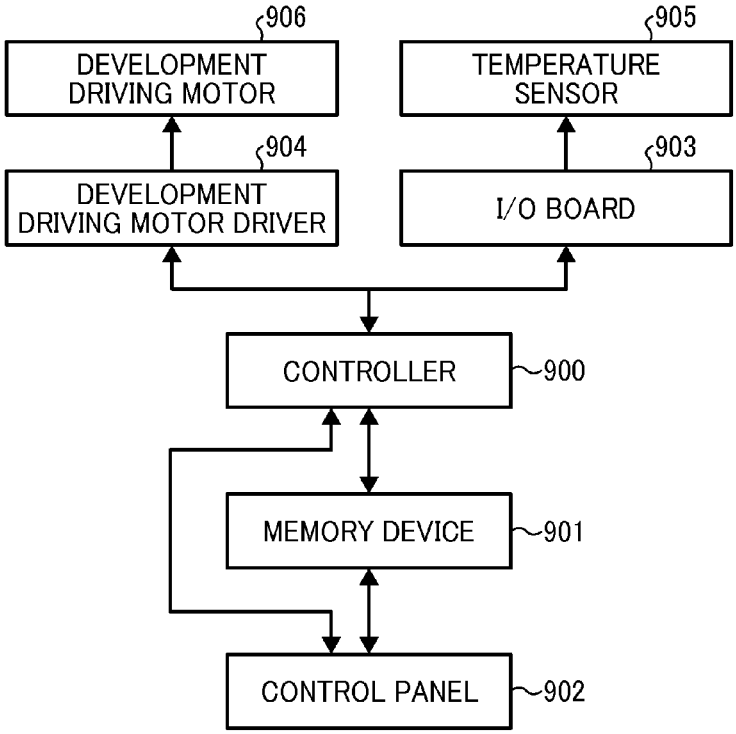
FIG. 4 is a function block diagram showing a main portion of a control system of the image forming apparatus according to an embodiment.

FIG. 4 is a function block diagram showing a main portion of a control circuitry of the image forming apparatus 200 of the above configuration.

In FIG. 4, a controller 900 includes, for example, a central processing unit (CPU), a read-only memory (ROM), and a random-access memory (RAM). The controller 900 is connected to a memory device 901 as a memory unit, a control panel 902 as an input unit, an input and output (I/O) board 903 as a temperature detection interface, and a development driving motor driver 904 as a developer bearer driving unit.

According to instructions from the controller 900, the I/O board 903 causes a temperature sensor 905 provided inside the developing device 7 or adjacent to the developing device 7 inside the apparatus body to execute temperature detection. Then, the I/O board 903 converts the voltage of a temperature detection signal (detected voltage) from the temperature sensor 905 to a digital signal to transmit the digital signal to the controller 900.

According to instructions from the controller 900, the development driving motor driver 904 supplies a predetermined voltage or electric current to a development driving motor 906 as the driving source of a developing roller 12. According to instructions from the controller 900, the development driving motor driver 904 rotates the developing sleeve 15 of the developing roller 12 at a predetermined rotational frequency, and turns on and off the rotation. The memory device 901 includes, for example, a semiconductor memory, a magnetic disc, and an optical disc, stores the data of detection results (i.e., detected temperatures) made by the temperature sensor 905, and stores setting data of various control conditions such as later-described threshold temperatures T1 and T2. The data in the memory device 901 can be written into and read by the controller 900.

The control panel 902 includes, for example, various buttons and a touch panel that can be operated by the user, and a liquid crystal display as a display unit, and also functions as an input unit that inputs various control conditions. Various data input and set to the control panel 902 operated by the user are stored in the memory device 901 via the controller 900, and can be used for control. The control panel 902 also functions as a report unit that reports timing of switching to the intermittent printing mode, in which the continuous-printing page limit is imposed.

The image forming apparatus 200 of the present embodiment also includes a temperature data acquisition unit to acquire data of outside air temperature (hereinafter "ambient temperature") outside the image forming apparatus 200. The temperature data acquisition unit can include, for example, a temperature sensor provided outside the image forming apparatus 200 and connected to the controller 900. The data of the ambient temperature detected by the temperature sensor can be stored in the memory device 901. The temperature data acquisition unit may use a communication interface that receives ambient temperature data from an external recording medium via a communication network, and may use the control panel 902 via which the user can input ambient temperature data.

The controller 900 can include, for example, a general-purpose microcomputer. All or part of the controller 900 may be constructed of an integrated circuit (IC) device designed to execute later-described controls and processes.

The controller 900 reads and executes a predetermined control program to execute various controls and processes as shown in the following (1) to (6):

(1) Instruct driving of the developing roller;

(2) Convert voltage detected by the temperature sensor to temperature, generating a detected temperature T;

(3) Determine and execute switching to the intermittent printing mode described later;

(4) Estimate and report time of switching to the intermittent printing mode described later;

(5) Change the first threshold temperature T1 in the intermittent printing mode described later; and (6) Change the second threshold temperature T2 in the intermittent printing mode described later.

Descriptions are given below of control processing based on the detected temperature according to the present embodiment.

In the control processing, the controller 900 according to the present embodiment controls the operation of the image forming apparatus 200 based on the detected temperature as the detection result generated by the temperature sensor 905 and predetermined threshold temperatures T1 and T2.

The controller 900 instructs the driving of the developing roller 12, and then converts the voltage detected by the temperature sensor 905 to a temperature value T (in degrees centigrade). The temperature value T (in degrees centigrade) of the conversion result is stored as the detected temperature T in the memory device 901. At the time of storing the detected temperature T, a current detected temperature T is compared with the predetermined threshold temperature T1 stored in the memory device 901.

When the detected temperature T is higher than the first threshold temperature T1 (T≥T1), the controller 900 switches the operation mode to the intermittent printing mode (also "in-apparatus cooling mode"), in which the quantity of pages (or number of sheets) on which images can be formed consecutively is limited to a predetermined count L (or continuous-printing page limit L) or smaller. In the intermittent printing mode, even when the printing request of a continuous printing operation (image formation) for total sheet count Li (>L) is instructed, the developing device 7 including the developing roller 12 is stopped and image formation goes standby for a predetermined period S (hereinafter "interval S") for each predetermined count L. That is, the instructed continuous printing operation (continuous image formation) for total sheet count Li is executed intermittently by each predetermined count L.

After the operation mode is switched to the intermittent printing mode, the controller 900 compares the current detected temperature T with the second threshold temperature T2 (<T1) stored in the memory device 901. If the current detected temperature T is lower than the second threshold temperature T2 (T<T2) at that time, the limit on the quantity of pages in continuous printing to the predetermined count L is canceled, and standard image formation (hereinafter "standard printing mode") is resumed, thus enabling continuous printing.

In the standard printing mode, when the printing request of the continuous printing operation for total sheet count Li (>L) is instructed, the image formation does not go standby, and thus the developing device 7 is not stopped for the predetermined interval S for each predetermined count L. In the standard printing mode, the instructed continuous printing operation (continuous image formation) for total sheet count Li is executed without bringing the image formation into the standby state.

The memory device 901 stores the setting values of threshold temperatures T1 and T2 used for determining the switching between the intermittent printing mode and the standard printing mode and predetermined count L according to this control example. The memory device 901 also stores control condition settings such as an interval S, described later, meaning standby time or a period from the driving stop of the developing roller 12 to the driving restart thereof in the intermittent printing mode.

The user can operate the control panel 902 to input the control condition setting values such as the setting values of threshold temperatures T1 and T2, predetermined count L, and the interval S. Thus, the control condition setting values such as threshold temperatures T1 and T2 stored in the memory device 901 can be changed to the input values. The control conditions such as threshold temperatures T1 and T2 can be optionally set by operating the control panel 902. Thus, the control conditions such as threshold temperatures T1 and T2 can be adjusted at user sites and markets according to individual usage environments and individual manners in which the image forming apparatus 200 is used. This configuration can reduce inconveniences such as toner fusion of developer due to the temperature rise of the developing roller 12 and restrict productivity reduction during printing onto recording sheets.

Figure 5:
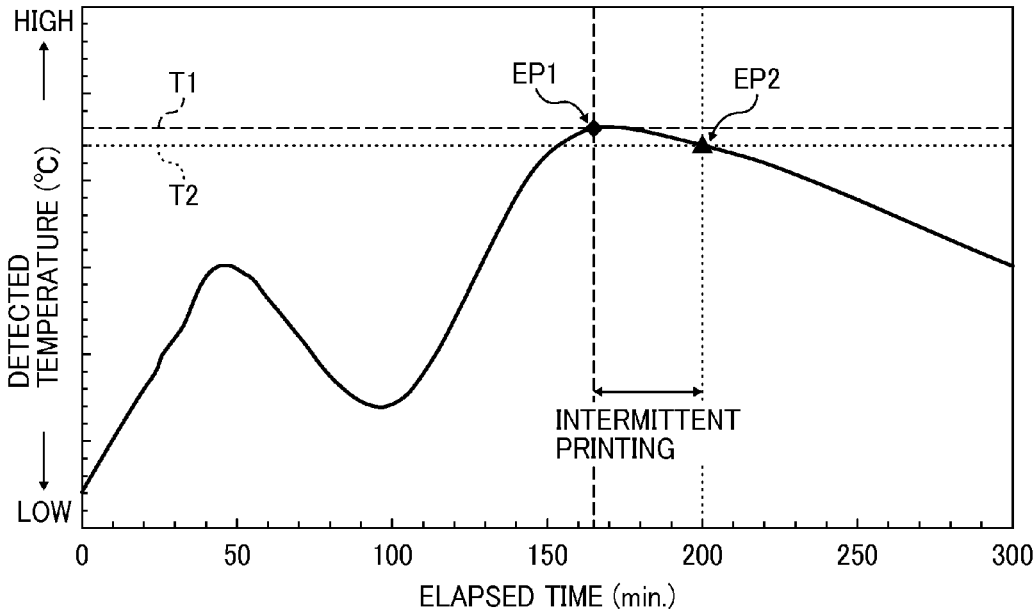
FIG. 5 is a graph showing changes over time in temperature of a developing unit detected by a temperature sensor, when switching between the intermittent printing mode and standard printing is executed according to an embodiment.

FIG. 5 is a graph showing an example of changes with time in detected temperature T of the developing device 7 when the switching between the intermittent printing mode and the standard printing mode is executed.

In FIG. 5, in a state where the apparatus is set in the standard printing mode capable of continuous printing, when the detected temperature T detected by the temperature sensor 905 is at the first threshold temperature T1 or greater as indicated by point EP1 shown in FIG. 5, the standard printing mode is switched to the intermittent printing mode. By switching the operation to the intermittent printing mode, even when it is requested to form images continuously on a large number of pages (total pages Li>L), the intermittent printing mode in which the number of pages continuously printed is limited to the predetermined count L is repeated. By doing this, downtime of the developing device 7 with respect to total printed sheet count Li is increased, thereby inhibiting further temperature rise of the developing device 7 (developing roller 12) or cooling the developing device 7. Allowing the interval S (e.g., minimum standby time) to be changed freely is advantageous to enable adjustment of the temperature of the developing device 7 in accordance with to the individual usage environments and individual usage manners of the image forming apparatus 200.

Thereafter, in the intermittent printing mode, when the detected temperature T detected by the temperature sensor 905 is lower than the second threshold temperature T2 (<T1) as indicated by point EP2 shown in FIG. 5, it can be determined that the temperature of the developing device 7 is sufficiently lowered. Based on this determination, the limit on the number of sheets continuously printable is canceled, thereby returning to the standard printing mode that enables continuous printing without the limit on the number of sheets continuously printable.

The predetermined limit (i.e., sheet count) L as the limit on the number of pages continuously printable in the intermittent printing mode and interval S from the driving stop of the developing device 7 to the re-driving thereof may be settable to any value according to the individual usage environments and usage manners via operating the control panel 902. In this case, inconveniences caused by the temperature rise of the developing roller 12 can be further reduced.

The set values of the control conditions such as the threshold temperatures T1 and T2, the predetermined count L as the limit on the number of pages continuously printable, and the interval S from the driving stop of the developing device 7 to the re-driving thereof in the intermittent printing mode according to this control example can be set by operating the control panel 902. That is, these set values can be set to any value according to the individual usage environments and usage manners by operating the control panel 902. Therefore, any malfunction due to the temperature rise of the developing roller 12 can be further reduced, so that productivity reduction during printing onto the recording sheet can be minimum.

The threshold temperatures T1 and T2 can be set to any value by the control panel 902, but the magnitude relation therebetween is preferably T1>T2. When the first threshold temperature T1 is higher than the second threshold temperature T2 (T1>T2), it is advantageous to inhibit toner fusion in the developing device 7 due to abrupt temperature rise when continuous printing is executed immediately after canceling the limit on the number of pages continuously printable.

Descriptions are given below of intervals S between printing jobs (image forming jobs) in which the number of pages of continuous printing is limited to the predetermined count L in the intermittent printing mode.

In the intermittent printing mode, printed recording sheet productivity is reduced to prevent the temperature rise of the developing device 7 to lower the temperature of the developing device 7. In the intermittent printing mode, the number of pages continuously printable are limited to the predetermined count L (sheet count L), so that the continuous printing job for sheet count Pi that is instructed to be printed is sectioned into continuous printing jobs for sheet count L less than Pi (hereinafter, referred to as a "page-limited job"). Thus, an interval time during which the driving of the developing roller 12 of the developing device 7 is stopped is provided so that the temperature of the developing device 7 can be lowered.

However, even when the operation mode is switched to the intermittent printing mode to execute printing intermittently, when the time between the sectioned page-limited jobs is short, after the completion of the previous page-limited job, the successive page-limited job comes. Therefore, immediately after the previous page-limited job is completed to stop the rotation of various motors as the driving source in the image forming apparatus 200, printing preparation for the successive page-limited job is started so that the motors are driven. In this way, the time during which the motors to drive the developing roller 12 of the developing device 7 are stopped are not sufficient. In particular, when the developing unit is hard to be cooled in a high temperature environment in which outside air temperature (ambient temperature) is high, the temperature rise of the developing device 7 is not reliably prevented only by limiting the number of pages continuously printable.

Figure 6:
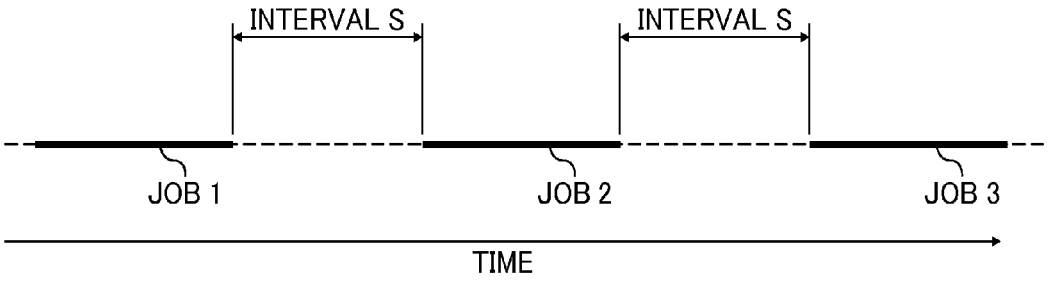
FIG. 6 is schematic diagram for understanding of intervals between page-limited jobs in the intermittent printing mode according to an embodiment.

Accordingly, as shown in FIG. 6, in the present embodiment, the predetermined interval S during which the printing operation (image forming) is not executed is provided between the page-limited jobs in the intermittent printing mode. In FIG. 6, JOB 1, JOB 2, and JOB 3 represent page-limited jobs. Thereby, the time during which the rotational driving of the developing roller 12 of the developing device 7 is forcefully stopped can be provided, so that the temperature of the developing device 7 can be efficiently lowered. The length of interval S may be changed based on the ambient temperature.

Descriptions are given below of report (notification) of switching time when the operation mode is switched to the intermittent printing mode.

Figure 7:
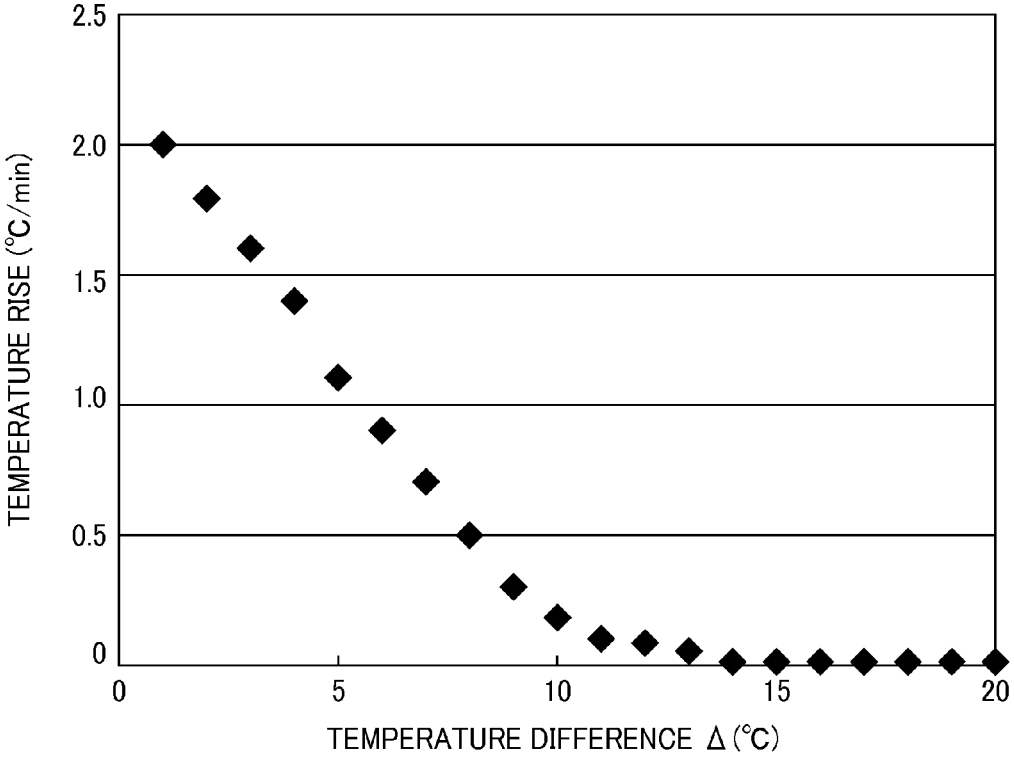
FIG. 7 is a graph showing an example of temperature rise characteristic of the developing unit.

FIG. 7 is a graph showing an example temperature rise characteristic of the developing device 7 of the image forming apparatus 200 according to the present embodiment.

FIG. 7 shows the temperature rise of the developing device 7 per unit time (one minute) when the image forming apparatus 200 of the present embodiment is continuously operated at full speed.

In FIG. 7, the horizontal axis (temperature difference Δ) shows the difference between the detected temperature of the developing device 7 and an ambient temperature, and the vertical axis shows the temperature rise per unit time (° C./min). When the temperature of the developing device 7 is close to the ambient temperature (the horizontal axis in FIG. 7 is close to 0° C.), the temperature is increased by approximately 2° C. per minute. On the other hand, when the temperature of the developing device 7 is higher than the ambient temperature by 15° C. or higher, the temperature of the developing device 7 is hardly increased.

From the result in FIG. 7, the following can be said.

That is, when the first threshold temperature T1 used for determining the switching from the standard printing mode to the intermittent printing mode is 45° C., it may be considered that there is little possibility that the detected temperature T of the developing device 7 reaches the first threshold temperature T1 under an ambient temperature of 30° C. or lower. Therefore, for instance, when the ambient temperature is less than 30° C., it may be unnecessary to report the switching time or switching timing at which the standard printing mode is switched to the intermittent printing mode (i.e., in-apparatus cooling mode).

On the other hand, when the ambient temperature is 30° C. or higher, the controller 900 predicts the possibility of switching to the intermittent printing mode and estimate the time of switching based on the difference between the current detected temperature T of the developing device 7 and the ambient temperature. For instance, the ambient temperature is 38° C., the first threshold temperature T1 is 45° C., and the detected temperature T of the developing device 7 is 43° C. It takes approximately one minute for the temperature of the developing device 7 to be 44° C. It takes 0.7 min for the temperature of the developing device 7 to be increased by 1° C. and 45° C. Thus, the controller 900 includes a prediction unit.

Therefore, it is reported that it is possible that the operation enters the intermittent printing mode 1.7 minutes later and continuous printing is limited. As a report example, the message "enter in-apparatus cooling mode 1.7 minutes later" can be displayed on the screen of the control panel 902 to report the switching timing to the user.

Figure 8:
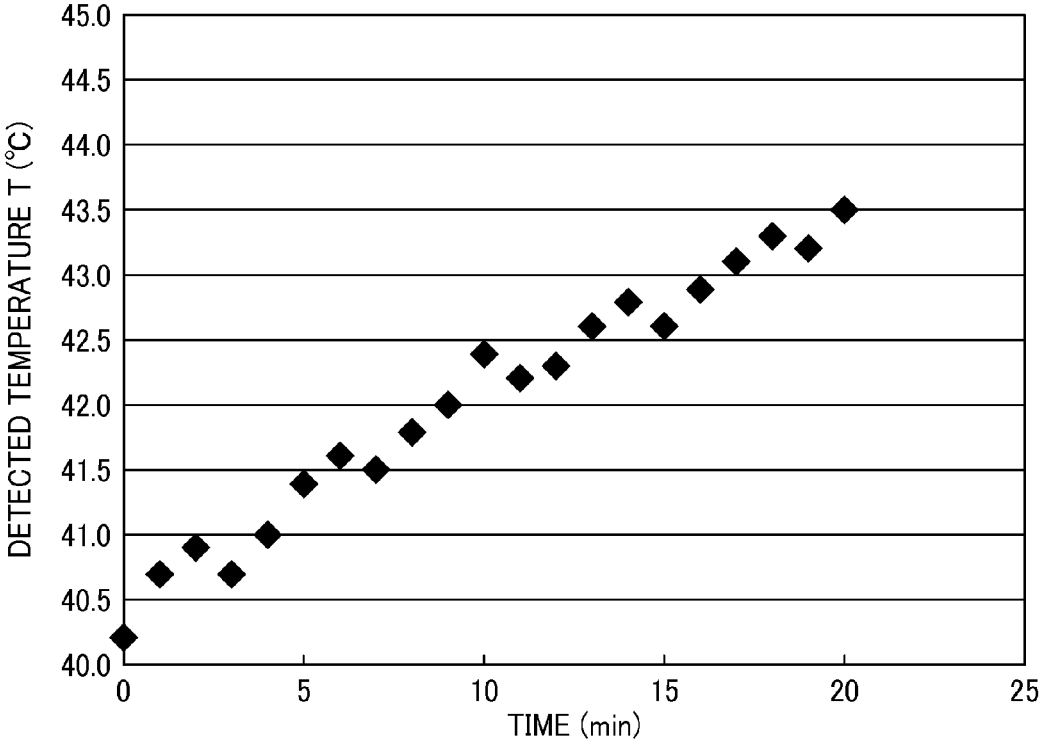
FIG. 8 is a graph showing an example of changes in temperature of the developing unit according to an embodiment.

FIG. 8 is a graph showing an example of changes in temperature of the developing device 7 in the image forming apparatus 200 of the present embodiment.

FIG. 8 shows changes in the detected temperature T of the developing device 7 over last 20 minutes.

In this case, as an immediate (last) temperature change, the temperature rise over last 10 minutes, which is a first immediate period, is calculated using an approximate equation. Then, a first time to the first threshold temperature T1, meaning a period of time until the detected temperature T reaches first threshold temperature T1 (e.g., 45° C.), is calculated. Further, as another immediate (last) temperature change, the temperature rise over last 20 minutes, which is a second immediate period, is calculated using an approximate equation. Then, a second time to the first threshold temperature T1, meaning the period required until the detected temperature T reaches the first threshold temperature T1 is calculated. The calculated first and second times are compared, and the shorter of the two is reported to the user.

From the following reasons, the temperature rise is approximated (calculated using approximate equation) using two or more different periods (e.g., the first and second immediate periods).

Even when temperature decreases over last 10 minutes, there is a possibility that the temperature is increased over last 20 minutes. Therefore, the approximation (calculation of using approximate equations) of temperature rise is desirably executed using as many different periods as possible.

Figure 9:
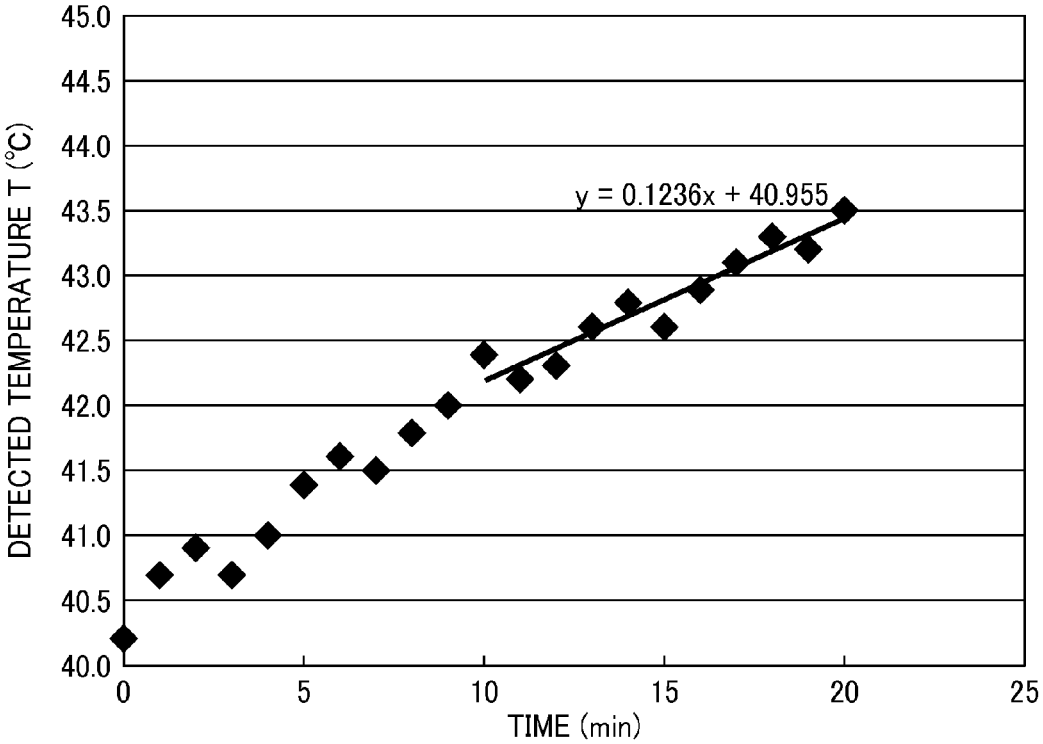
FIG. 9 is a graph showing an example of linear approximation in changes in temperature shown in FIG. 8.
Figure 10:
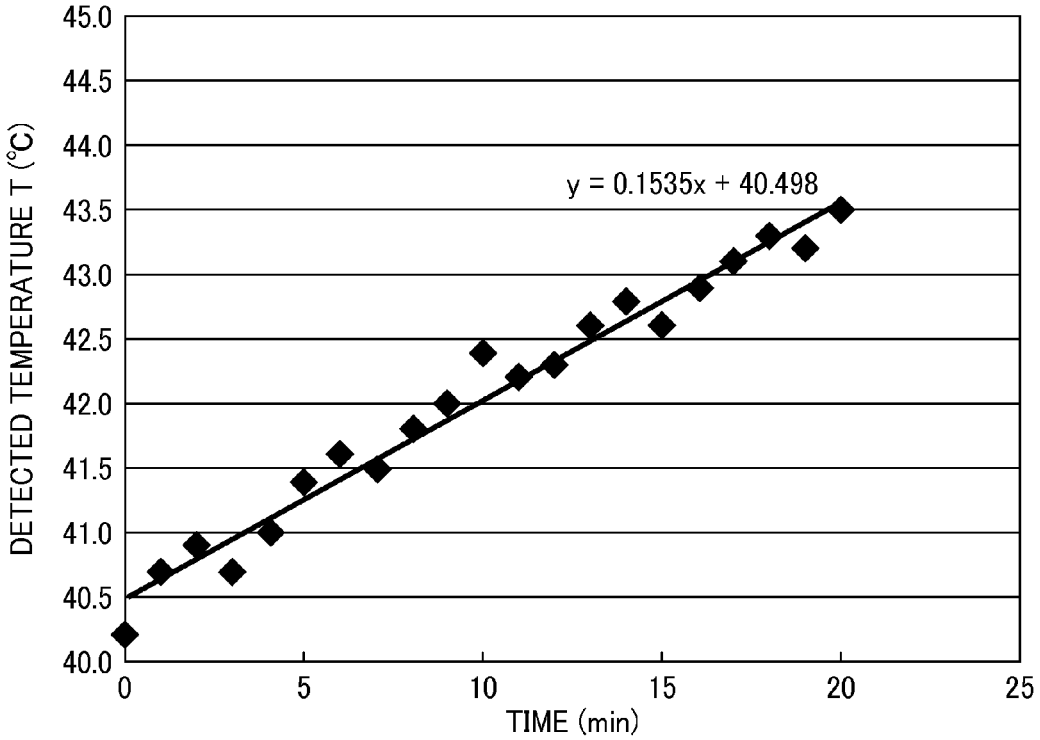
FIG. 10 is a graph showing another example of linear approximation in changes in temperature shown in FIG. 8.

For instance, as shown in FIG. 9, the temperature rise over last 10 minutes is linearly approximated. From the approximate equation, the first time, meaning the period until the detected temperature T reaches first threshold temperature T1, is calculated. Then, it can be predicted that it takes 32.7 min. As shown in FIG. 10, the temperature rise over last 20 minutes is linearly approximated. From the approximate equation, the second time, meaning the period until the detected temperature T reaches the first threshold temperature T1, is calculated. Then, it can be predicted that it takes 29.3 min. In this case, 29.3 minutes later, the standard printing mode is switched to the intermittent printing mode (in-apparatus cooling mode) to report that there is a possibility of limiting the productivity.

It is to be noted that, in the examples shown in FIGS. 9 and 10, the temperature change approximation is executed by linear approximation using a linear function, but may be executed by other functions.

Descriptions are given below of changing the first threshold temperature T1 and the second threshold temperature T2 used for determining switching between the standard printing mode and the intermittent printing mode (in-apparatus cooling mode).

For instance, the value of threshold temperature T1 may be changed depending on the presence or absence of a peripheral device (e.g., a finisher that processes sheets P on which images are formed) and the manner in which the image forming apparatus 200 is used. Here, the value of threshold temperature T2 may be changed according to the change of threshold temperature T1 (similar in the following threshold temperature change control). The relation between the temperature of the developing device 7 and the detected temperature T detected by the temperature sensor 905 depending on the presence or absence of the peripheral device and the manner in which the apparatus is used can be linearly approximated. Therefore, the second threshold temperature T2 may be changed an amount identical or similar to the amount by which the first threshold temperature T1 is changed.

The temperature sensor 905 measures the temperatures inside the developing device 7 and that of developer. However, developing devices are typically replaceable components, and accordingly the temperature sensor 905 is often attached to the apparatus body near the developing device 7. When the distance between the temperature sensor 905 and the developing device 7 is long, the correlation between the detected temperature T detected by the temperature sensor 905 and an actual temperature of the developing device 7 fluctuates due to various factors such as airflow around the temperature sensor 905, the operation mode, the operation type, and the set temperature of the heat source for fixing. Therefore, there can be cases where the actual temperature of the developing device 7 is not flatly obtained from the detected temperature T. In addition, there can be measurement errors in the temperature sensor 905. For instance, when the temperature sensor 905 is a sensor that detects temperature according to changes in resistance, the measurement error is caused in the temperature sensor 905 when an error is caused in the resistance. Although design margin may be secured in the first threshold temperature T1 to cope with these errors, it is necessary to start the intermittent printing mode (in-apparatus cooling mode) from a temperature lower than the threshold temperature T1 as a target, resulting in productivity reduction. Therefore, to minimize productivity reduction, the measurement error in the temperature sensor 905 is required to be reduced.

Accordingly, in the present embodiment, the correlation coefficient (coefficient in approximate equations) between the detected temperature T and the temperature of the developing device 7 may be changed depending on conditions that affect the correlation between the detected temperature T and the temperature of the developing device 7. The conditions that affect the correlation can include the presence or absence of the peripheral device, the operation mode, airflow around the temperature sensor 905, and the setting temperature of the heat source for fixing. In this case, the temperature of the developing device 7 can be measured more precisely by the temperature sensor 905.

It is to be noted that "operation mode" includes various operation modes and image formation types in which the sheet feeding conditions are different. For instance, the operation mode includes single-side printing, double-side printing, a mode that continuously feeds a large number of sheets, a mode that feeds several sheets in which the number of sheets is different in each printing job, full-color (FC) printing, and black and white (BW) printing.

For instance, when the peripheral device is provided to the image forming apparatus 200 of the present embodiment, airflow in the body of the image forming apparatus 200 can be blocked. Therefore, the airflow in the image forming apparatus 200 can be changed. Such airflow change affects the correlation between the detected temperature T detected by the temperature sensor 905 and the actual temperature of the developing device 7.

It is to be noted that "actual temperature of the developing device 7" shown in FIGS. 11 to 16 means temperature experimentally detected, for example, by disposing a thermocouple contactlessly inside the developing device (i.e., inside a developing casing) or adjacent to the developing roller in a test apparatus.

Figure 11:
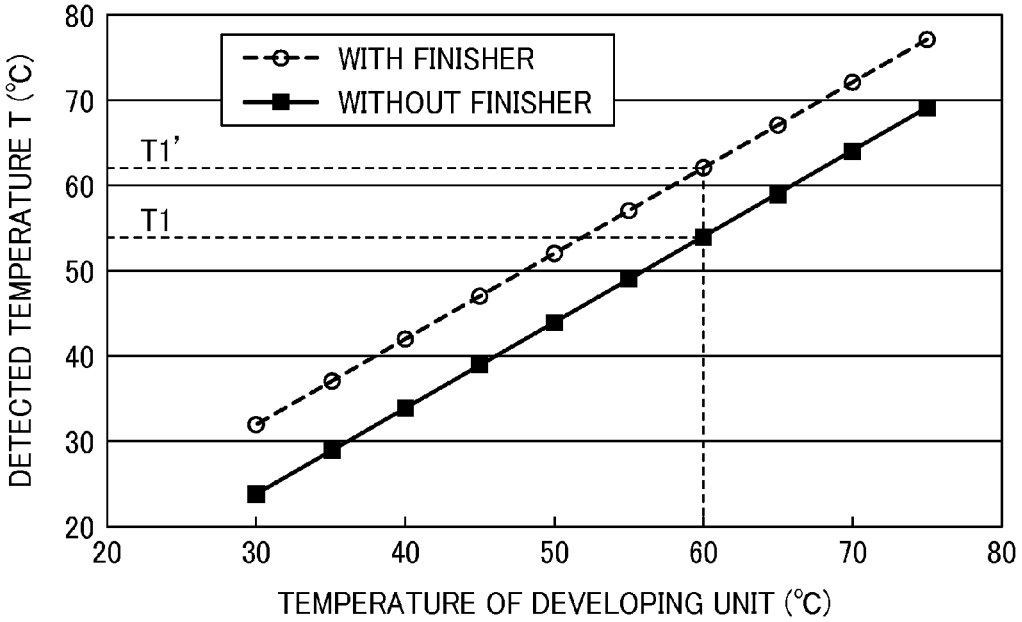
FIG. 11 is a graph showing an example correlation between temperature of the developing unit detected by the temperature sensor (hereinafter "detected temperature") and actual temperature of the developing unit in a case with finisher and a case without the finisher.

FIG. 11 is a graph showing an example correlation between the detected temperature T detected by the temperature sensor 905 and the actual temperature of the developing device 7 in each of the presence and absence of the finisher as the peripheral device in the image forming apparatus 200 of the present embodiment.

As shown in FIG. 11, depending on the presence or absence of the finisher, the correlation between the detected temperature T detected by the temperature sensor 905 and the actual temperature of the developing device 7 is greatly changed. In the printer of the type having such characteristic in FIG. 11, for instance, as illustrated in Examples 1 and 2, the developing device 7 can be prevented from being heated to 60° C.

Example 1

In example 1, the presence or absence of the finisher is not considered. As shown in FIG. 11, when the temperature of the developing device 7 is 60° C., the result (detected temperature T) of detection made by the temperature sensor 905 is 54° C. to 62° C. depending on the presence or absence of the finisher. When the value of detected temperature T detected by the temperature sensor 905 reaches 54° C. in the absence of the finisher, the intermittent printing mode (in-apparatus cooling mode) is executed to lower the temperature of the developing device 7 to 60° C. or below. Therefore, switching to the intermittent printing mode is to be started to lower the temperature of the developing device 7. On the other hand, although the detected temperature T detected by the temperature sensor 905 reaches 54° C. in the presence of the finisher, the actual temperature of the developing device 7 is only 52° C. If the intermittent printing mode is started at that time, the productivity is unnecessarily reduced by the amount corresponding to 8° C.

Example 2

In example 2, the presence or absence of the finisher is considered. The correlation data in FIG. 11 are linearly approximated. When the finisher is present, Formula 1 shown below is used to calculate a linear approximate equation. When the finisher is absent, Formula 2 shown below is used.

In the formulas below, x represents the temperature of the developing device 7, and y represents the detected temperature T detected by the temperature sensor 905.

$$y=a'x+b' \quad \text{(Formula 1)}$$

$$y=a\,x+b \quad \text{(Formula 2)}$$

Further, when the temperature of the developing device 7 is controlled at 60° C. or lower, Formulas 3 and 4 shown below are used to calculate a linear approximate equation. When the finisher is present, Formula 3 is used. When the finisher is absent, Formula 4 is used.

$$y'=a'\times 60[^\circ\text{ C.}]+b' \quad \text{(Formula 3)}$$

$$y''=a\times 60[^\circ\text{ C.}]+b \quad \text{(Formula 4)}$$

In the presence of the finisher, the value of y' of Formula 3 is set to the first threshold temperature T1. In the absence of the finisher, the value of y" of Formula 4 is set to the first threshold temperature T1.

Specifically, the values of y' and y" can be read as 62° C. and 54° C. in the graph in FIG. 11. Therefore, the value of first threshold temperature T1 is set to 62° C. in the presence of the finisher, and is set to 54° C. in the absence of the finisher.

Compared with Example 1, in Example 2, the measurement error in the temperature sensor 905 caused by the difference between the presence and absence of the finisher (peripheral device) can be significantly reduced. In this way, multiple candidate values previously set as the first threshold temperature T1 may be switched depending on the presence or absence of the finisher (peripheral device). Therefore, the measurement error in the temperature sensor 905 can be reduced. The threshold temperature T2 may be switched together with the first threshold temperature T1.

Figure 12:
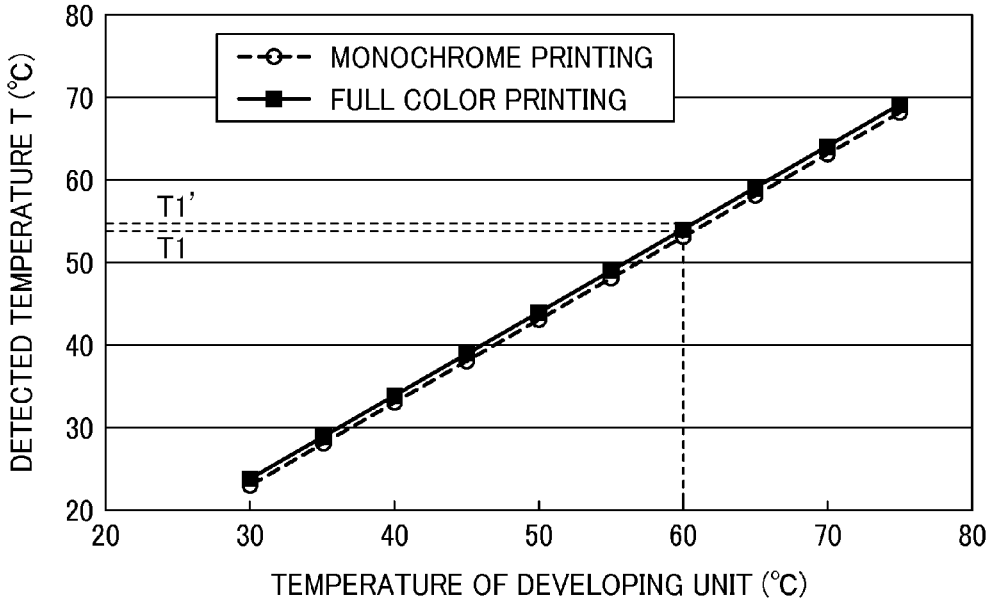
FIG. 12 is a graph showing an example correlation between the detected temperature and the actual temperature of the developing unit in each of monochrome image formation and full color image formation.

FIG. 12 is a graph showing an example correlation between the detected temperature T and the actual temperature of the developing device 7 in each of monochrome image formation (monochrome or black toner mode) and full-color image formation (full-color mode) of the image forming apparatus 200 of the present embodiment.

Typically, full-color image formation (hereinafter also "FC mode") employs a higher fixing temperature and a larger number of driving motors than the monochrome image formation (hereinafter also "BW mode"). Consequently, in the FC mode, the temperature in the image forming apparatus is often high. Accordingly, for instance, if the ratio of monochrome images is higher in image formation executed immediately, the first threshold temperature T1 is raised to prevent the switching to the intermittent printing mode, thereby inhibiting productivity reduction. In addition, when the rate of FC images is higher in image formation to be executed immediately, the first threshold temperature T1 is lowered to facilitate the switching to the intermittent printing mode, thereby reliably inhibiting the temperature rise in the image forming apparatus 200.

It is to be noted that, in the example shown in FIG. 12, the difference between the BW mode and the FC mode hardly affect the correlation between the detected temperature T and the actual temperature of the developing device 7. Therefore, in such a case, even when the apparatus is likely to be hot in the FC mode, it is not necessary to change the first threshold temperature T1 depending on the BW mode and the FC mode. Additionally, it is not necessary to change the correlation coefficient (coefficient of the approximate equation) showing the correlation between the detected temperature T and the actual temperature of the developing device 7 depending which of the BW mode and the FC mode is used.

Figure 13:
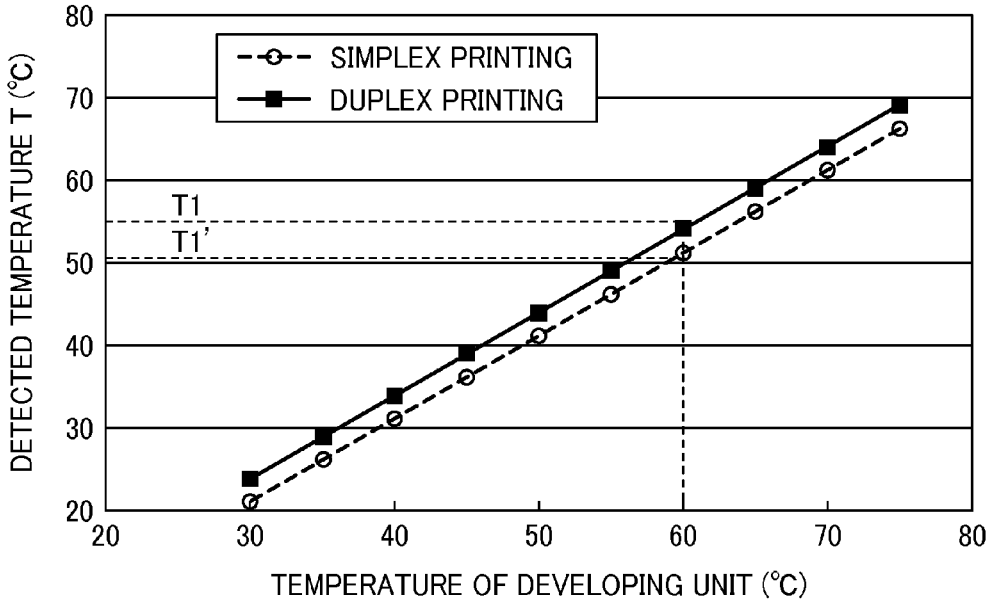
FIG. 13 is a graph showing an example correlation between the detected temperature and the actual temperature of the developing unit in single-side printing and double-side printing.

FIG. 13 is a graph showing an example correlation between the detected temperature T and the actual temperature of the developing device 7 in each case of single-side image formation (hereinafter also "single-side mode") and double-side image formation (hereinafter also "double-side mode").

Compared with single-side sheet feeding in the single-side mode, even with the same driving time of the developing device 7, temperature near the fixing device 60 is likely to be higher in double-side sheet feeding in the double-side mode since the hot recording sheet carrying a fixing image again enters the fixing device 60. Therefore, when detecting the temperature of developer, which is significantly affected by the development driving heat, the temperature sensor 905 is likely to be affected by the temperature near the fixing device 60 and to be easily heated. Therefore, as shown in FIG. 13, the single-side mode that forms an image on one side of the recording sheet and the double-side mode that forms an image on both sides of the recording sheet have different correlation coefficients showing the correlation between the detected temperature T detected by the temperature sensor 905 and the actual temperature of the developing device 7. Accordingly, in the image forming apparatus 200 of the present embodiment, the first threshold temperature T1 may be switched between the single-side mode and the double-side mode to change the switching timing to the intermittent printing mode. For instance, as shown in FIG. 11, in the single-side mode, the value of y' of Formula 3 is set to the first threshold temperature T1, and in the double-side mode, the value of y" of Formula 4 is set to the first threshold temperature T1.

However, the temperature rise of the developing device 7 varies in accordance with the percentage of sheets output in single-side mode and the percentage of sheets output in the double-side mode. Therefore, the first threshold temperature T1 may be switched in accordance with the rate of sheets output in single-side printing (single-side print percentage) or the rate of sheets output in double-side printing (double-side print percentage) in immediate image formation. For instance, double-side print percentage a (%) is calculated over last 1000 recording sheets, and is then used to calculate y'" expressed by Formula 5, so that the value of y'" is set to the first threshold temperature T1.

$$y'''=\{(100-a)/100\}\times y'+(a/100)\times y'' \quad \text{(Formula 5)}$$

Figure 14:
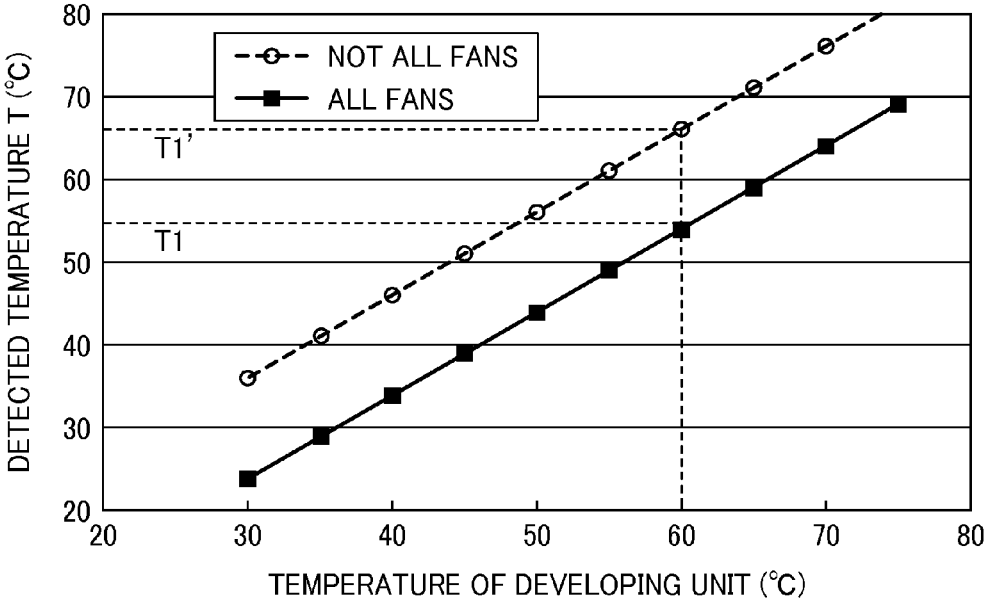
FIG. 14 is a graph showing an example correlation between detected temperature and the actual temperature of the developing unit when all fans are operated and some of the fans are operated.

FIG. 14 is a graph showing an example correlation between the detected temperature T and the actual temperature of the developing device 7 in two cases in which the number of fans being operated for generating airflow in the image forming apparatus 200 are different. Specifically, all of the fans are operated in one case, and some of the fans are operated in the other case.

When the distance between the temperature sensor 905 and the developing device 7 in the image forming apparatus 200 is long, airflow in the image forming apparatus 200 is affected by the number of fans being operated. Such airflow change affects the correlation (correlation coefficient) between the detected temperature T detected by the temperature sensor 905 and the actual temperature of the developing device 7. The temperature correlation (correlation coefficient) thus differs depending on the operation of the fans. Therefore, the first threshold temperature T1 used for determining the switching timing to the intermittent printing mode may be switched in accordance with the number of fans that are being operated.

Figure 15:
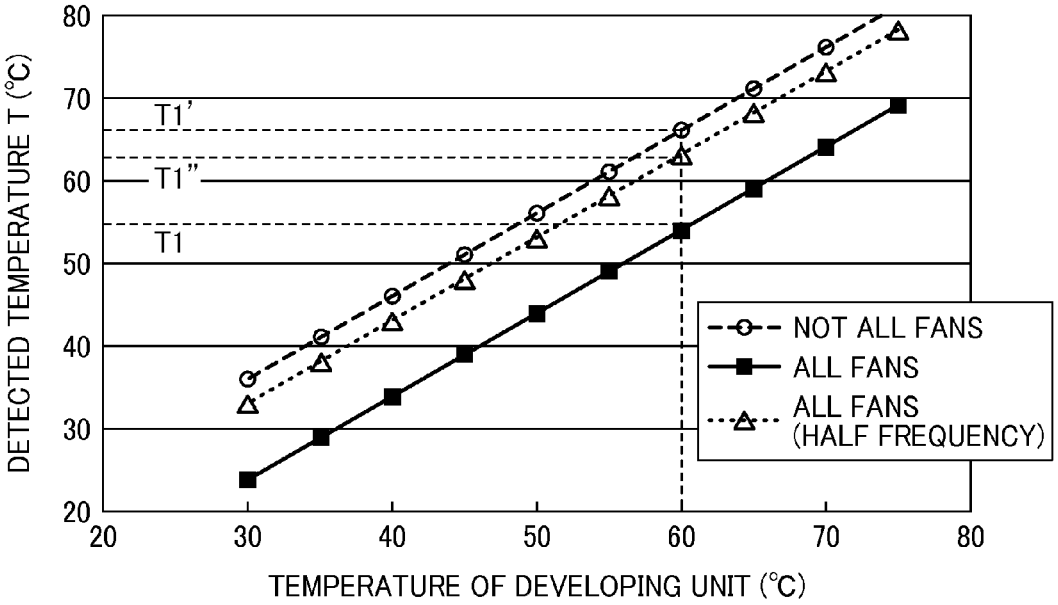
FIG. 15 is a graph showing an example correlation between detected temperature and the actual temperature of the developing unit in each of cases in which fan speeds are different.

FIG. 15 is a graph showing an example correlation between the detected temperature T detected by the temperature sensor 905 and the actual temperature of the developing device 7 in each of cases in which the fans provided in the image forming apparatus 200 are rotated at different rotational frequencies.

To obtain the graph of "all fans (half frequency)" shown in FIG. 15, voltage input to the fans is adjusted so that the rotational frequency and the air amount become half of those when all of the fans are operated (as a standard state). Similar to the case of "not all fans" in which only some of the fans are operated, when all of the fans are operated at the half rotational frequency, the correlation between the temperature sensor 905 and the developer temperature varies. In addition, the airflow in the image forming apparatus 200 can be changed according to the rotational frequency of the fans which are being operated. Therefore, the first threshold temperature T1 used for determining the switching timing to the intermittent printing mode may be changed in accordance with the rotational frequency of the fans which are being operated.

Figure 16:
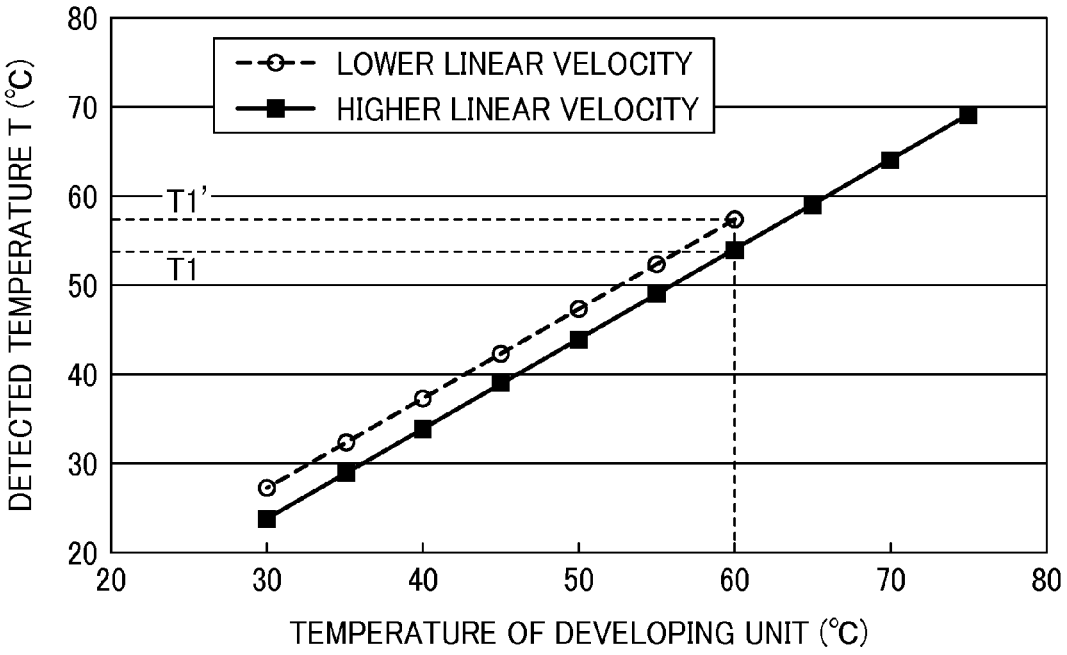
FIG. 16 is a graph showing an example correlation between detected temperature and the actual temperature of the developing unit in each of cases in which the linear velocities at which a photoreceptor moves are different from each other.

FIG. 16 is a graph showing an example correlation between the detected temperature T and the actual temperature of the developing device 7 in each of cases in which the rotational velocity of the photoreceptor 3 is different.

The data of "higher linear velocity" shown in FIG. 16 is obtained when the operation linear velocity of the photoreceptor 3 is 255 (mm/sec). The data of "lower linear velocity" shown in FIG. 16 is obtained when the operation linear velocity of the photoreceptor 3 is 154 (mm/sec). As shown in FIG. 16, the airflow in the image forming apparatus 200 can be changed according to the surface moving velocity (linear velocity) of the photoreceptor 3, serving as an image bearer, and the surface moving velocity (linear velocity) of the developing roller 12, serving as a developer bearer. Therefore, the first threshold temperature T1 used for determining the switching timing to the intermittent printing mode may be switched in accordance with at least one of the surface moving velocity (linear velocity) of the photoreceptor 3 and that of the developing roller 12.

It is to be noted that, in the present embodiment, the control examples described above may be combined as needed. For instance, the data of the correlation (correlation coefficient) may be previously obtained for each combination of the control examples, multiple threshold temperatures T1 and T2 for each combination may be stored in a table, and preferable threshold temperatures T1 and T2 may be selected from the table. In addition, when the control examples are combined, the increase and decrease in the temperature correction in various conditions may be simply added.

It is to be noted that the description above concerns an example, and the present embodiment can provide effects specific to each of the following aspects.

(Aspect A)

An image forming apparatus such as the image forming apparatus 200 includes a latent image forming unit such as the optical writing unit 20 to form a latent image on an image bearer such as the photoreceptor 3, and a developing device such as the developing device 7 to develop the latent image with developer such as toner borne on a developer bearer such as the developing roller 12 and is executable continuously image formation on multiple pages (or multiple sheets). The image forming apparatus further includes a temperature sensor such as the temperature sensor 905 to detect temperature inside the developing device or adjacent thereto that changes corresponding to temperature of the developer bearer, a controller such as the controller 900 to impose a limit on the quantity of pages in continuous printing and cancellation of the limit based on the detection result generated by the temperature sensor, and a report unit such as the control panel 902 to report time when the apparatus enters an operation mode in which the quantity of pages in continuous printing is limited.

With this configuration, as described above, the temperature sensor such as the temperature sensor 905 detects the temperature inside the developing device such as the developing device 7 or adjacent thereto that changes corresponding to temperature of the developer bearer. Based on the detection result, the limit on the quantity of pages in continuous printing and cancellation of the limit are controlled. When it is determined based on the detection result that the developer bearer such as the developing roller 12 is excessively heated, the quantity of pages in continuous printing is limited to stop the operation of the developing device including the developer bearer, thereby inhibiting the excessive temperature rise of the developer bearer. Therefore, fusion of developer due to the excessive temperature rise of developer on the developer bearer can be inhibited. In addition, when it is determined based on the detection result that the developer bearer is not excessively heated, the limit on the quantity of pages in continuous printing is canceled. Then, image formation can be continuously executed without stopping the developing device including the developer bearer. Therefore, efficiency reduction during continuous image formation can be avoided.

Further, for the control of the limit on the quantity of pages in continuous printing and cancellation of the limit, the detection result of temperature inside the developing device or adjacent thereto that changes corresponding to temperature of the developer bearer is used. Therefore, it is unnecessary to compute estimated temperatures of the developer bearer and that of developer in the developing device.

Furthermore, time data indicating from when the quantity of pages in continuous printing is limited can be reported to the user. Based on the report, the user can grasp the timing at which the quantity of pages in continuous printing is limited. Therefore, the user can adjust image forming schedule in accordance with the priority of images to be formed, and can manage image formation. Without executing the computation to estimate the temperatures of the developer bearer and the developer in the developing device, efficiency reduction during continuous image formation can be avoided to prevent fusion of developer due to the excessive temperature rise of developer on the developer bearer, and the user can manage image formation.

(Aspect B)

In aspect A, the image forming apparatus further includes a prediction unit, such as the controller 900, to predict a switching time at which the operation mode is switched from the mode without limitation on the quantity of pages in continuous printing to the mode in which the quantity of pages in continuous printing is limited based on the detection result of the temperature sensor such as the temperature sensor 905. The report unit such as the control panel 902 reports the predicted switching time.

As described above, this configuration enables prediction of the switching time at which the mode without limitation on the quantity of pages in continuous printing is switched to the mode that limits the quantity of pages in continuous printing, and the prediction can be reported to the user. Based on the report, the user can grasp when the mode without limitation on the quantity of pages in continuous printing is switched to the mode that limits the quantity of pages in continuous printing. Therefore, the user can adjust the image forming schedule according to the priority of images to be formed, considering the switching time. Thus, the user can manage image formation.

(Aspect C)

In aspect B, the prediction unit such as the controller 900 predicts the switching time based on an immediate temperature change detected by the temperature sensor such as the temperature sensor 905 over an immediate past period.

With this configuration, as described above, the switching time is predicted based on changes in temperature during the immediate past that greatly affect the above-described switching of the mode, thereby increasing the prediction accuracy of the switching time.

(Aspect D)

In aspect B or C, the prediction unit such as the controller 900 predicts the switching time based on each of multiple immediate temperature changes respectively detected over multiple different periods, and the report unit such as the control panel 902 reports the earliest one among the switching times predicted by the prediction unit.

With this configuration, since the switching time is predicted based on each of the multiple immediate changes in the temperature detected over multiple different periods, errors in predicting the switching time can be reduced. In addition, since the earliest one among the multiple predicted switching times is reported, the switching to the mode that limits the quantity of pages in continuous printing can be more reliably avoided from being executed earlier than then the reported time.

(Aspect E)

In any one of aspects B to D, the image forming apparatus further includes a temperature data acquisition unit to acquire ambient temperature data indicating ambient temperature outside the image forming apparatus, and the prediction unit such as the controller 900 predicts the switching time based on the difference between the ambient temperature and the detected temperature T.

With this configuration, as described above, the switching time is predicted based on the difference between the ambient temperature and the detected temperature T which greatly affects switching to the mode that limits the quantity of pages in continuous printing.

Therefore, the prediction accuracy of the switching time can be higher.

(Aspect F)

In any one of aspects A to D, the controller such as the controller 900 controls the limit on the quantity of pages in continuous printing and cancellation of the limit based on the detection result of the temperature sensor such as the temperature sensor 905 and multiple predetermined threshold temperatures.

With this configuration, since the detection result of the temperature sensor is compared with the multiple threshold temperatures, the detected temperature at which the limit on the quantity of pages in continuous printing is imposed and the detected temperature at which the limit is canceled can be different from each other. The limit on the quantity of pages in continuous printing can be imposed at multiple stages, at multiple different detecting temperatures.

(Aspect G)

In any one of aspects A to F, the controller such as the controller 900 limits the quantity of pages in continuous image formation to the predetermined count L or smaller when the detected temperature T detected by the temperature sensor such as the temperature sensor 905 is at the predetermined threshold temperature T1 or higher, and then, cancels the limit on the quantity of pages when the detected temperature T is lower than the predetermined threshold temperature T2.

With this configuration, as described above, the limit on the quantity of pages in continuous printing and cancellation of the limit are controlled based on the comparison result of detected temperature T and threshold temperatures T1 and T2. Thereby, the control can be simpler than that in a configurations that employ computation results of temperature estimation.

(Aspect H)

In any one of aspects A to G, when the detected temperature T detected by the temperature sensor such as the temperature sensor 905 is at the predetermined threshold temperature T1 or higher, the controller such as the controller 900 executes switching to the predetermined image formation mode with limit in which the quantity of pages in continuous image formation is limited to the predetermined count L or smaller. When the detected temperature T is lower than the predetermined threshold temperature T2, the controller cancels the limit, thereby switching the mode to the standard image formation mode.

With this configuration, as described above, the predetermined image formation mode with limit and the standard image formation mode are previously set. Thus, the limit on the quantity of pages in continuous printing and cancellation of the limit can be made with the simple control.

(Aspect I)

In aspect G or H, the image forming apparatus further includes a memory unit such as the memory device 901 to store the setting values of the first and second threshold temperatures T1 and T2. The controller such as the controller 900 imposes the limit on the quantity of pages in continuous printing and cancels the limit based on the setting values of the threshold temperatures stored in the memory unit.

With this configuration, as described above, the first and second threshold temperatures T1 and T2 can be set to any value according to the individual usage environments and usage manners to control the switching between the intermittent printing mode and the standard printing mode. Therefore, any malfunction such as fusion of developer due to the temperature rise of the developer bearer can be reduced more reliably, thereby restricting productivity reduction during image forming. In addition, threshold temperatures T1 and T2 are stored in the memory unit. Therefore, threshold temperatures T1 and T2 can be reused in the control thereafter, thereby enhancing the efficiency of the control.

(Aspect J)

In aspect I, the controller such as the controller 900 changes the setting value of the threshold temperatures based on the presence or absence of a peripheral device such as a finisher mounted or connected around the image forming apparatus.

With this configuration, as described above, the influence of the measurement error in the temperature sensor due to the presence or absence of the peripheral device can be reduced.

(Aspect K)

In aspect I, the controller such as the controller 900 can selectively execute full-color image formation and monochrome image formation, and changes the setting value of the threshold temperatures based on the rates of full color images and monochrome images produced in an immediate image forming operation.

With this configuration, as described above, the influence of the measurement error in the temperature sensor due to the ratio between full-color images and monochrome images produced in the immediate image forming operation can be reduced.

(Aspect L)

In aspect I, the controller such as the controller 900 can selectively execute a single-side image formation which forms an image on one side of a recording medium such as recording sheet P and a double-side image formation which forms images on both sides of the recording medium, and changes the setting value of the threshold temperatures based on the ratio between the single-side image formation and double-side image formation in a predetermined number of sheets output during the immediate past.

With this configuration, as described above, the influence of the measurement error in the temperature sensor due to the rate of single-side image formation and that of double-side image formation in a predetermined number of sheets output during the immediate past can be reduced.

(Aspect M)

In aspect I, the controller such as the controller 900 changes the setting values of the threshold temperatures based on the quantity of pages or number of sheets per a single immediate image forming job.

With this configuration, as described above, the influence of the measurement error in the temperature sensor due to the quantity of pages per a single immediate image forming job can be reduced.

(Aspect N)

In aspect I, the image forming apparatus further includes multiple fans to generate airflow in the image forming apparatus, and the controller changes the setting values of the threshold temperatures based on the number of fans being operated.

With this configuration, as described above, the influence of the measurement error in the temperature sensor due to the difference in the number of fans being operated can be reduced.

(Aspect O)

In aspect I, the image forming apparatus further includes a fan to generate airflow in the image forming apparatus, and the controller changes the setting values of the threshold temperatures based on the rotational frequency of the fan.

With this configuration, as described above, the influence of the measurement error in the temperature sensor due to the difference in rotational frequency of the fan can be reduced.

(Aspect P)

In aspect I, the controller such as the controller 900 changes the setting values of the threshold temperatures based on at least one of the surface moving velocity (linear velocity) of the image bearer such as the photoreceptor 3 and the surface moving velocity (linear velocity) of the developer bearer such as the developing roller 12.

With this configuration, as described above, the influence of the measurement error in the temperature sensor due to the difference in at least one of the surface moving velocity of the image bearer and the surface moving velocity of the developer bearer can be reduced.

(Aspect Q)

In any one of aspects I to P, the image forming apparatus further includes a threshold temperature input unit such as the control panel 902 to input at least one of the setting values of first threshold temperature T1 and second threshold temperature T2. The controller such as the controller 900 changes the setting values of the threshold temperatures stored in the memory unit to the setting value of the threshold temperature input by the threshold temperature input unit.

With this configuration, as described above, threshold temperatures T1 and T2 can be set to any value to control the switching to the intermittent printing mode and the standard printing mode. In addition, the user can set threshold temperatures T1 and T2 according to the individual usage environments and usage manners in an actually used location and market. Therefore, any malfunction such as toner fusion of developer due to the temperature rise of the developer bearer such as the developing roller 12 can be further reduced, so that productivity reduction during image forming can be minimum.

(Aspect R)

In any one of aspects I to P, the magnitude relation between the first and second threshold temperatures T1 and T2 is T1>T2.

This configuration can inhibit toner fusion in the developing device such as the developing device 7 including the developer bearer such as the developing roller 12 due to abrupt temperature rise when continuous printing is executed immediately after the limit on the quantity of pages in continuous image formation is canceled.

It is to be noted that spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section.

Still further, any one of the above-described and other example features of the present invention, for example, limiting and cancellation of the number of pages in continuous image formation, may be embodied in the form of method, computer program, and computer program product. Any of the aforementioned methods may be embodied in the form of a program and stored on a computer readable media and is adapted to perform any one of the aforementioned methods when run on a computer device (a device including a processor). Thus, the storage medium or computer readable medium is adapted to store information and is adapted to interact with a data processing facility or computer device to perform the method of any of the above mentioned embodiments.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus capable of continuous image formation on multiple pages, the image forming apparatus comprising:

an image bearer configured to bear an image;

a latent image forming unit configured to form a latent image on the image bearer;

a developing device configured to develop the latent image with toner;

a temperature sensor disposed inside the image forming apparatus and configured to detect temperature inside the developing device;

a controller configured to impose a limit on a quantity of pages in continuous image formation, to cancel the limit according to a detection result generated by the temperature sensor, to estimate times at which the limit is imposed based on multiple past changes in temperature; and a report unit configured to report an earliest of the times.

2. The image forming apparatus according to claim 1, further comprising a temperature data acquisition unit to acquire ambient temperature outside the image forming apparatus, wherein the controller predicts the time at which the limit is imposed based on a difference between the ambient temperature and a temperature detected by the temperature sensor.

3. The image forming apparatus according to claim 1, wherein the controller imposes the limit and cancels the limit based on multiple predetermined threshold temperatures and the detection result generated by the temperature sensor.

4. The image forming apparatus according to claim 1, wherein the controller switches an operation mode to a mode with the limit on the quantity of pages in continuous image formation when a temperature detected by the temperature sensor is at a first threshold temperature or higher, the limit limiting the quantity of pages in continuous image formation to a predetermined count or smaller, and the controller switches the mode with the limit to a mode without the limit when the temperature detected by the temperature sensor falls to a second threshold temperature or lower, the second threshold temperature lower than the first threshold temperature.

5. The image forming apparatus according to claim 1, wherein the controller imposes the limit when a temperature detected by the temperature sensor is at a first threshold temperature or higher, the limit limiting the quantity of pages in continuous image formation to a predetermined count or smaller, and the controller cancel the limit when the temperature detected by the temperature sensor falls to a second threshold temperature or lower, the second threshold temperature lower than the first threshold temperature.

6. The image forming apparatus according to claim 5, further comprising a memory unit to store setting values of the first and second threshold temperatures, wherein the controller imposes and cancels the limit based on the setting values of the first and second threshold temperatures stored in the memory unit.

7. The image forming apparatus according to claim 6, wherein the controller changes the setting values of the first and second threshold temperatures depending on presence or absence of a peripheral device provided to the image forming apparatus.

8. The image forming apparatus according to claim 6, wherein full-color image formation and monochrome image formation is selectively executed, and the controller changes the setting values of the first and second threshold temperatures in accordance with a ratio between full-color images and monochrome images produced in immediate image formation.

9. The image forming apparatus according to claim 6, wherein single-side image formation and double-side image formation is selectively executed, and the controller changes the setting values of the first and second threshold temperatures in accordance with a ratio between single-side sheets each carrying an image on one side thereof and double-side sheets each carrying images on both sides thereof, the ratio in immediate image formation.

10. The image forming apparatus according to claim 6, wherein the controller changes the setting values of the first and second threshold temperatures in accordance with the quantity of pages or number of sheets on which images are formed in a single immediate image forming job.

11. The image forming apparatus according to claim 6, further comprising multiple fans to generate airflow in the image forming apparatus, and the controller changes the setting values of the first and second threshold temperatures in accordance with a quantity of fans being operated out of the multiple fans.

12. The image forming apparatus according to claim 6, further comprising a fan to generate airflow in the image forming apparatus, and the controller changes the setting values of the first and second threshold temperatures in accordance with a rotational frequency of the fan.

13. The image forming apparatus according to claim 6, wherein the controller changes the setting values of the first and second threshold temperatures in accordance with at least one of a linear velocity at which a surface of the image bearer moves and a linear velocity at which a surface of the developer bearer moves.

14. The image forming apparatus according to claim 6, further comprising a threshold temperature input unit to input the setting value of at least one of the first and second threshold temperatures, wherein the controller changes the setting value stored in the memory unit to the setting value input by the threshold temperature input unit.

* * * * *